US006214112B1

(12) United States Patent
Plomer

(10) Patent No.: US 6,214,112 B1
(45) Date of Patent: Apr. 10, 2001

(54) DEVICE FOR DIRECT OR INDIRECT SINGLE OR DOUBLE SIDED APPLICATION OF A LIQUID OR VISCOUS COATING MEDIUM ONTO A MOVING SURFACE

(75) Inventor: Anton Plomer, Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/289,235

(22) Filed: Apr. 9, 1999

(30) Foreign Application Priority Data

Apr. 11, 1998 (DE) ..... 198 16 337

(51) Int. Cl.[7] ..... B05C 1/08

(52) U.S. Cl. ..... 118/249; 118/255; 118/257; 118/259; 118/304; 118/410; 118/413

(58) Field of Search ..... 118/123, 126, 118/227, 249, 255, 257, 259, 260, 304, 410, 413; 427/428, 356, 402

(56) References Cited

U.S. PATENT DOCUMENTS

| | | | | |
|---|---|---|---|---|
| 5,516,365 | | 5/1996 | Sandberg et al. | 118/118 |
| 5,626,676 | * | 5/1997 | Voswinckel | 118/123 |
| 5,735,953 | * | 4/1998 | Paulsen | 118/249 |
| 5,789,022 | | 8/1998 | Kustermann et al. | 427/211 |
| 5,795,357 | * | 8/1998 | Kim | 118/249 |

FOREIGN PATENT DOCUMENTS

| | | | | |
|---|---|---|---|---|
| 2238846 | | 11/1998 | (CA) . | |
| 36 05 409 C2 | | 2/1986 | (DE) . | |
| 197 22 159A1 | | 5/1997 | (DE) . | |
| 0 617 167 A1 | | 9/1994 | (EP) . | |
| 0 812 957 A1 | | 4/1997 | (EP) . | |
| 0 781 608 A2 | | 7/1997 | (EP) . | |
| 0 794 287 A1 | | 9/1997 | (EP) . | |
| WO 93/17182 | | 9/1993 | (WO) . | |
| WO 95/12031 | | 5/1995 | (WO) . | |
| 95/17264 | * | 6/1995 | (WO) | 118/126 |
| WO 96/19617 | | 6/1996 | (WO) . | |
| WO 97/13035 | | 4/1997 | (WO) . | |

OTHER PUBLICATIONS

Edward D. Cohen et al, Modern Coating and Drying Technology, p. 8, 1992.*

* cited by examiner

*Primary Examiner*—Laura Edwards
(74) *Attorney, Agent, or Firm*—Taylor & Aust, P.C.

(57) ABSTRACT

In a device for direct or indirect single or double sided application of a liquid or viscid coating medium onto a moving surface with a scoop roll, a nozzle applicator device is positioned prior to the scoop roll relative to the direction of travel of the moving surface.

18 Claims, 1 Drawing Sheet

DEVICE FOR DIRECT OR INDIRECT SINGLE OR DOUBLE SIDED APPLICATION OF A LIQUID OR VISCOUS COATING MEDIUM ONTO A MOVING SURFACE

BACKGROUND OF THE INVENTION

1. Field of the Invention

The present invention relates to a device for direct or indirect single or double sided application of a liquid or viscous coating medium onto a moving surface.

2. Description of the Related Art

An applicator unit of this type, referred to as a roll applicator, is known from German patent document no. 3,605,409. Such an applicator unit is typically categorized as a Long Dwell Time Applicator.

The scoop roll of an applicator unit typically applies a relatively large amount of coating medium to the moving surface, which is generally an applicator roll or a material web. The volume of coating medium applied onto the moving surface is proportional to the diameter and circumferential speed of the scoop roll. However, there are limits imposed due to splashing of the coating medium as the circumferential speed of the scoop roll increases.

If, due to space constraints or design considerations, a relatively small scoop roll is utilized, the scooping effect is often not sufficient to produce uniform coating on the material web.

Therefore, what is needed in the art is an apparatus which utilizes a relatively small scoop roll and yet produces a uniform coating on the moving surface, or material web.

SUMMARY OF THE INVENTION

The present invention spreads a coating medium evenly and uniformly across the machine width by use of a nozzle applicator device which is installed prior to the scoop roll of the applicator unit relative to the direction of travel of the material web or, equivalently, the rotational direction of the applicator roll. The scoop roll and the nozzle applicator device are assigned or positioned adjacent to the same applicator roll in the case of indirect application, or adjacent to the same backing roll in the case of direct application. In the case of direct application the backing roll is partially wrapped by the material web. This configuration results in a compact arrangement which requires little space.

The nozzle applicator device may be configured as an impulse coater which is equipped with a machine-wide metering nip, as described in WO 95/12031. The nozzle applicator device, however, may also be an applicator whereby the coating medium is directly applied onto the moving surface by individual nozzles which are arranged uniformly across the width of the machine. An individual nozzle applicator device of this type is described in the German patent application 197 22 159.9, which is assigned to the assignee of the present invention. In an applicator of the individual nozzle type, the nozzle arrangement is such that the jets of coating medium exiting from the nozzles overlap on the moving surface thereby ensuring complete coverage of the moving surface with the coating medium.

The present invention applies only a pre-coating to the moving surface with the nozzle applicator device. The main coating is accomplished by the scoop roll. Any excessively applied medium is subsequently removed with a doctoring device, thereby ensuring a uniform coating application both in the transverse and longitudinal direction of the material web relative to the direction of travel thereof. The uniform coating results from the thin layer of applied pre-coating and relatively low volume main coating application. The pre-coating compensates for, or supplements, the reduced scooping effect at relatively small, for example, 350 mm, scoop roll diameters.

This embodiment is particularly suitable for applications where there is already a roll applicator device of this type in the paper machine or the converting machine. In such an instance, the coating machine can easily be retrofitted with the nozzle applicator device, specifically the impulse coating device. In instances where application of coating medium by use of individual nozzles is preferred, the entire coating application is performed with this device. Sufficient coverage of the material web is accomplished by the overlapping areas of the individual nozzle jets.

Where there are already roll applicator units in the paper or converting machine, the scoop roll is not required to fulfill its actual purpose of scooping and applying the coating medium. In the embodiment having individual applicator nozzles, the scoop roll is utilized for leveling and/or averaging out of the applied coating medium, thereby providing an advantageous method of smoothing the overlapping end sections of the individual jets in the nip between the scoop roll and the moving surface by evenly distributing any applied excess of coating medium.

In the embodiment in which the scoop roll is utilized for scooping the main volume of the coating medium, the roll runs in the opposite direction of, and at a lower circumferential speed than, the moving surface or material web.

In the embodiment in which the scoop roll is used for spreading out or evenly distributing the layer of coating medium which was applied with the nozzle applicator device, rather than for scooping, then the scoop roll may run in the same direction as the moving surface or material web. When the scoop roll is used for spreading out or leveling the applied coating medium, it may or may not be driven. On new coating lines, a metering rod, particularly one having a large diameter and smooth surface, may be used for leveling the applied layer of coating medium rather than the scoop roll.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
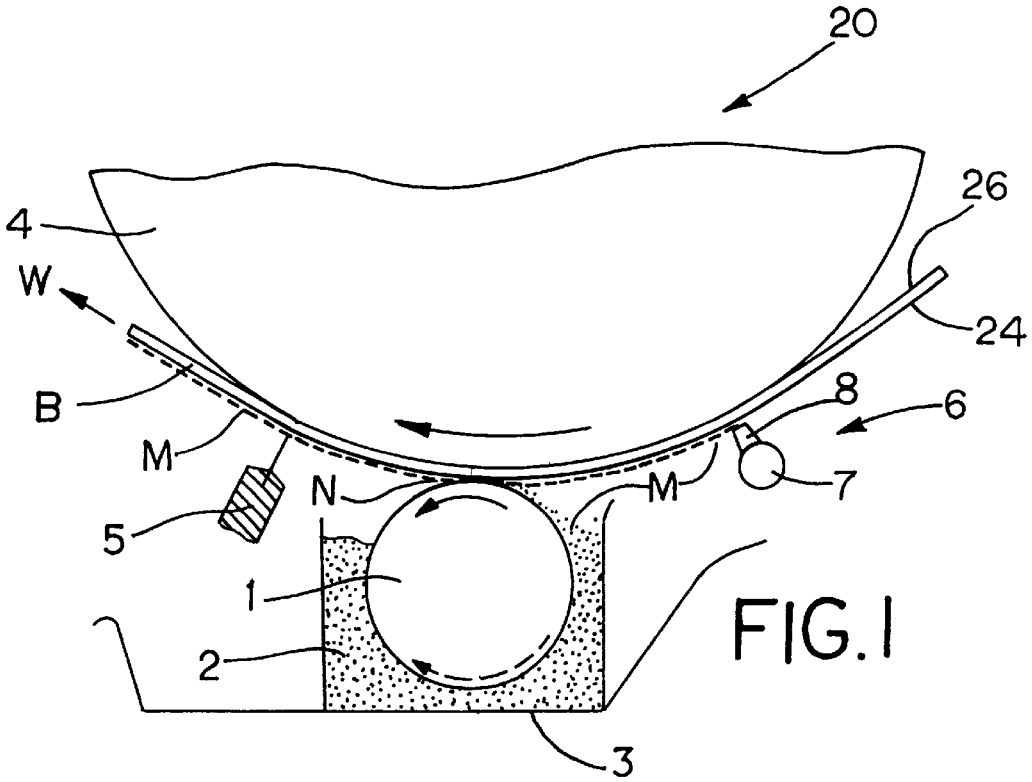
FIG. 1 is a schematic side view of an applicator device for the direct application of a liquid or viscid coating medium onto a moving surface of the present invention.

Referring now to the drawings and particularly to FIG. 1, there is shown one embodiment of an applicator unit 20 of the present invention.

Applicator unit 20 includes scoop roll 1 rotating in a sump 2 of coating medium M. Sump 2 is in a trough (not shown) with a collecting pan 3. Scoop roll 1, as a moving surface, is assigned or positioned adjacent to backing roll 4, which is wrapped by paper web B. Scoop roll 1 and backing roll 4 have opposite rotational directions relative to each other and form a nip N in which coating medium M is deposited directly onto paper web B. That is, scoop roll 1 is shown rotating in a counterclockwise direction, and backing roll 4 is shown rotating clockwise. Applicator device 6 is positioned adjacent to and a slight predetermined distance from backing roll 4, prior to scoop roll 1 relative to the direction of travel W of material web B. Coating medium supply pipe 7 is equipped with a multitude of individual nozzles 8, arranged along the length of coating medium supply pipe 7. A pre-coating is applied to material web B with nozzles 8. The main volume of the coating is then applied by scoop roll 1.

Applicator device 6 can be configured to apply the entire volume of coating medium M. In this embodiment, no coating medium M is supplied to scoop roll 1. Instead, scoop roll 1 functions to level the layer of coating medium M which was applied to material web B by applicator device 6. In doing so, scoop roll 1 can be configured to rotate in the same direction as backing roll 4, thereby achieving a better spreading effect (see broken line arrow indicating clockwise rotation of scoop roll 1 in FIG. 1).

Doctoring device 5 is positioned after scoop roll 1 relative to the direction of travel of material web B. Doctoring device 5 can be configured as a doctor blade, a metering rod or a stationary doctor bar. In the embodiment shown, doctoring device 5 is configured as a doctor blade which removes excess applied coating medium M from paper web B. The excess coating medium M is collected in a trough (not shown) and is recirculated to the coating process.

Figure 2:
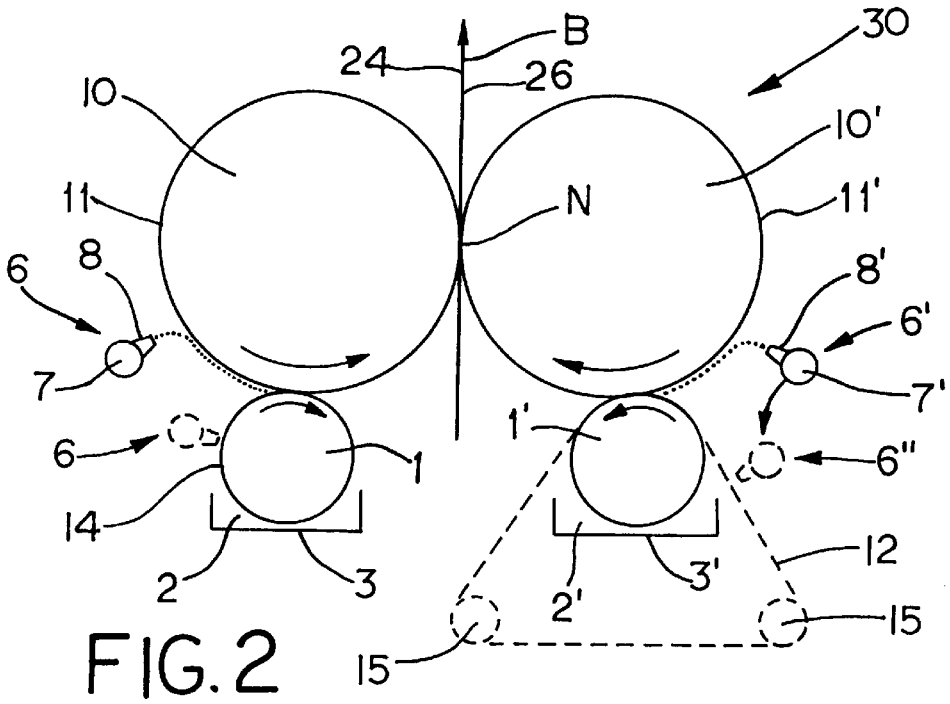
FIG. 2 is a schematic side view of a second, third, and fourth embodiment of an applicator of the present invention.

Referring now to FIG. 2, a second embodiment of an applicator unit 30 of the present invention for the application of a liquid or viscid coating medium onto a moving surface is presented. In this embodiment, coating medium M is indirectly applied to both sides 24 and 26 of material web B. Applicator rolls 10 and 10' form nip N through which material web B travels. Coating medium M is transferred from applicator rolls 10 and 10' to material web B in nip N. Scoop rolls 1 and 1' with a corresponding one of collecting pans 3 and 3' are respectively assigned or positioned adjacent to a respective one of applicator rolls 10 and 10'. Nozzle applicator devices 6 and 6' are located prior to a respective one of scoop rolls 1 and 1' relative to the rotational direction of their respective applicator rolls 10 and 10', and at a small predetermined distance from their respective scoop rolls 1 and 1'.

In another embodiment, illustrated by showing nozzle applicator device 6 in broken lines on the lower-left side of FIG. 2 adjacent to scoop roll 1, achieves single-sided application of a liquid or viscid coating medium onto moving material web B. In this embodiment, nozzle applicator device 6, instead of being positioned adjacent to applicator roll 10, is alternatively configured to be assigned or positioned adjacent to scoop roll 1. In this position, nozzle applicator 6 pre-coats outer surface 14 of scoop roll 1. Outer surface 14 of scoop roll 1 transfers coating medium M to outer surface 11 of applicator roll 10 which, in turn, transfers coating medium M onto moving material web B. This same structure described above when duplicated on the right side of applicator unit 30, i.e. associated with each of scoop roll 1 and scoop roll 1', achieves double-sided coating of material web B.

Yet another embodiment is illustrated on the right side of FIG. 2, in the area of scoop roll 1', in broken lines. This embodiment achieves single-sided application of a liquid or viscid coating medium onto moving material web B. This embodiment includes continuous belt 12 traveling around scoop roll 1' and around guide rolls 15. In this configuration, scoop roll 1' acts as a support roll, that is, it does not apply any coating medium M. Nozzle device 6", of the same design as 6 or 6', sprays or emits coating medium M, additionally or alone, onto continuous belt 12. Continuous belt 12 transfers coating medium M onto applicator roll 10' which, in turn, transfers coating medium M onto side 26 of material web B. If material web B is to be coated on both sides, the structure recited above is associated with each of scoop rolls 1 and 1'. If single sided coating is desired in a configuration in which the recited structure is associated with each of scoop roll 1 and scoop roll 1', just one side of applicator unit 30 is selectively operated to place coating medium M onto continuous belt 12 or its counterpart associated with scoop roll 1, i.e. on the left side of applicator unit 30.

FIG. 2 illustrates a material web B moving upward away from applicator roll 10 and 10' relative to scoop rolls 1 and 1'. It is to be understood that a different path for material web B may be selected with appropriately adjusted rotational direction for applicator rolls 10 and 10' and scoop rolls 1 and 1'. This illustrated arrangement is only one example and is not intended to restrict the scope of protection of the present invention.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for one of single sided and double sided direct application of a first coating medium onto a moving fiber material web, the moving fiber material web having a direction of travel, a first side and a second side, said apparatus comprising:

a backing roll configured for supporting the second side of the moving fiber material web;

a first supply of the first coating medium;

a scoop roll associated with the first side of the moving fiber material web and with said first supply, said scoop roll being positioned and configured for applying a main coating of the first coating medium onto the first side of the moving fiber material web;

a second supply of the first coating medium; and a nozzle applicator device fluidly coupled with said second supply and configured for applying the first coating medium onto the first side of the moving fiber material web, said nozzle applicator device being disposed prior to and adjacent said scoop roll relative to the direction of travel of the moving fiber material web, said nozzle applicator device being positioned and configured to apply a pre-coating of the first coating medium onto the first side of the moving fiber material web.

2. The apparatus of claim 1, wherein said apparatus has a width, said nozzle applicator device comprising a coater having a metering nip extending substantially across said width of said apparatus.

3. The apparatus of claim 1, wherein said apparatus has a width, said nozzle applicator device comprising:

a coating medium distribution pipe having a length, said coating medium distribution pipe extending transversely substantially across said width of said apparatus; and a plurality of individual nozzles substantially evenly distributed along said length of said coating medium distribution pipe.

4. An apparatus for one of single sided and double sided direct application of a coating medium onto a moving fiber material web, the moving fiber material web having a direction of travel, a first side and a second side, said apparatus comprising:

a backing roll configured for supporting the second side of the moving fiber material web;

a scoop roll associated with the first side of the moving fiber material web; and a nozzle applicator device configured for applying the coating medium onto the first side of the moving fiber material web, said nozzle applicator device being disposed prior to said scoop roll relative to the direction of travel of the moving fiber material web, only said nozzle applicator device being positioned and configured for applying the coating medium onto the moving fiber material web, said scoop roll being positioned and configured for leveling the coating medium applied by said nozzle applicator device.

5. The apparatus of claim 1, further comprising a coating medium sump containing coating medium, said scoop roll being disposed at least partially within said coating medium sump and configured to rotate at least partially within the coating medium contained by said coating medium sump.

6. The apparatus of claim 1, wherein said scoop roll is configured to rotate in the direction of travel of the moving fiber material web at a nip defined therebetween.

7. The apparatus of claim 1, wherein said scoop roll is configured to rotate in a direction opposite to the direction of travel of the moving fiber material web at a nip defined therebetween.

8. The apparatus of claim 1, wherein said first scoop roll is configured to be freely rotatable.

9. An apparatus for indirect single sided application of a coating medium onto a moving fiber material web, the moving fiber material web having a direction of travel, said apparatus comprising:

an applicator roll associated with the moving fiber material web, said applicator roll having a rotational direction equal to the direction of travel of the moving fiber material web at a first nip defined therebetween, said applicator roll being configured for transferring the coating medium onto the moving fiber material web;

a scoop roll associated with said applicator roll and defining a second nip therebetween, said scoop roll having a direction of rotation; and a first nozzle applicator device associated with said applicator roll, said first nozzle applicator device being configured for applying the coating medium onto a surface of said applicator roll, said first nozzle applicator device being disposed adjacent and prior to said scoop roll and prior to said nip relative to said rotational direction of said applicator roll, said first nozzle applicator being directed at one of said applicator roll and said scoop roll prior to said second nip relative to said direction of rotation of said scoop roll.

10. The apparatus of claim 9, wherein said first nozzle applicator device is associated with said scoop roll, said first nozzle applicator device being configured for applying the coating medium onto a surface of said scoop roll.

11. The apparatus of claim 9, further comprising a coating medium sump, said scoop roll being at least partially disposed within said coating medium sump and configured to rotate at least partially within the coating medium contained by said coating medium sump.

12. The apparatus of claim 9, further comprising:

at least one guide roll;

a continuous belt carried by said scoop roll and said at least one guide roll, said continuous belt being configured for transferring the coating medium onto a surface of said applicator roll; and a second nozzle applicator device associated with said continuous belt, said second nozzle applicator device being configured for applying the coating medium onto said continuous belt.

13. An apparatus for indirect double sided application of coating medium onto a moving fiber material web, the moving fiber material web having a direction of travel, a first side and a second side, said apparatus comprising:

a first applicator roll associated with the first side of the moving fiber material web, said first applicator roll having a rotational direction equal to the direction of travel of the moving fiber material web at a first nip defined therebetween, said first applicator roll being configured for transferring the coating medium onto the first side of the moving fiber material web;

a first scoop roll associated with said first applicator roll;

a first nozzle applicator device associated with said first applicator roll, said first nozzle applicator device being disposed prior to said first scoop roll and prior to said first nip relative to said rotational direction of said first applicator roll;

a second applicator roll associated with the second side of the moving fiber material web, said second applicator roll having a rotational direction equal to the direction of travel of the moving fiber material web at a second nip defined therebetween, said second applicator roll being configured for transferring the coating medium onto the second side of the moving fiber material web;

a second scoop roll associated with said second applicator roll; and a second nozzle applicator device associated with said second applicator roll, said second nozzle applicator device being disposed prior to said second scoop roll and prior to said second nip relative to said rotational direction of said second applicator roll.

14. The apparatus of claim 13, wherein said apparatus has a width, said first nozzle applicator device and said second nozzle applicator device each comprising a respective impulse coater, each said impulse coater having a metering nip extending substantially across said width of said apparatus.

15. The apparatus of claim 13, wherein said apparatus has a width, said first nozzle applicator device and said second nozzle applicator device each comprising:

a respective coating medium distribution pipe, each said coating medium distribution pipe having a length and extending substantially across said width of said apparatus; and a respective plurality of individual nozzles, each said plurality of individual nozzles substantially evenly distributed along said length of a respective said coating medium distribution pipe.

16. The apparatus of claim 13, wherein each said nozzle applicator device is configured to apply a pre-coating of the coating medium onto a corresponding one of said first applicator roll and said second applicator roll, each of said first scoop roll and said second scoop roll being configured for applying a main coating of the coating medium onto a corresponding one of said first applicator roll and said second applicator roll.

17. The apparatus of claim 13, further comprising:

a first coating medium sump containing coating medium, said first scoop roll being at least partially disposed within said first coating medium sump and configured to rotate at least partially within the coating medium contained by said first coating medium sump; and a second coating medium sump containing coating medium, said second scoop roll being at least partially disposed within said second coating medium sump and configured to rotate at least partially within the coating medium contained by said second coating medium sump.

18. The apparatus of claim 13, wherein only said first nozzle applicator device and said second nozzle applicator device are configured for applying the coating medium, each of said first scoop roll and said second scoop roll being configured for leveling the coating medium applied by a corresponding one of said first applicator roll and said second applicator roll.

* * * * *